United States Patent [19]

Smith

[11] Patent Number: 5,005,742

[45] Date of Patent: Apr. 9, 1991

[54] FLAT GARMENT HANGER WITH RETAINER SLOTS

[76] Inventor: James C. Smith, 11852 - 11th Ave. S., Seattle, Wash. 98168-2124

[21] Appl. No.: 464,548

[22] Filed: Jan. 16, 1990

[51] Int. Cl.[5] ..... A47G 25/14; A47G 25/26; A47G 25/28; A47G 25/34

[52] U.S. Cl. ..... 223/87; 223/85; 223/88; 223/92; 223/95

[58] Field of Search ..... 223/85, 87, 92, 95, 223/88, 91, 93, 96, DIG.3, DIG. 1; D6/315

[56] References Cited

U.S. PATENT DOCUMENTS

| | | | |
|---|---|---|---|
| D. 182,023 | 2/1958 | Seeger | D6/315 |
| D. 191,647 | 10/1961 | Gleich et al. | D6/315 |
| 631,102 | 8/1899 | Bigsby et al. | 223/88 |
| 1,607,749 | 11/1926 | Rice | 223/88 |
| 1,797,364 | 3/1931 | Porter | 223/92 |
| 1,962,712 | 6/1934 | Dukes | 223/88 |
| 2,129,871 | 10/1938 | Reed | 223/88 |
| 2,150,869 | 3/1939 | Shafarman | 223/88 |
| 2,222,231 | 11/1940 | Marble | 223/88 |
| 2,515,544 | 7/1950 | Artley | 223/95 |
| 2,620,103 | 12/1952 | Antolini | 223/88 |
| 2,991,919 | 7/1961 | Zuckerman | 223/88 |
| 3,085,725 | 4/1963 | Caparosa | 223/DIG. 1 |
| 3,317,095 | 5/1967 | Kerns | 223/87 |
| 3,378,180 | 4/1968 | Singer | 223/87 |
| 4,148,421 | 4/1979 | Levitt | 223/87 |
| 4,623,079 | 11/1986 | Tendrup et al. | 223/85 |
| 4,629,102 | 12/1986 | Tendrup et al. | 223/85 |

FOREIGN PATENT DOCUMENTS

| | | | |
|---|---|---|---|
| 1369748 | 3/1964 | France | 223/95 |

*Primary Examiner*—Werner H. Schroeder
*Assistant Examiner*—Bibhu Mohanty
*Attorney, Agent, or Firm*—George M. Cole

[57] ABSTRACT

Hanger device for clothing and particularly womens under garments which includes an elongated flat, plastic body (10) having a central hook section (15) and including at each end a depending end portion (32,34). The end sections include a saw tooth type slot (30) extending upwardly and inwardly at a predetermined angle from end edge (20). The saw tooth shape of the slot defines a series of coacting triangular teeth. The depending end sections include a flexible lower end portion (34). A second slot (40) may be included to angle downwardly and outwardly from the top edges (16) if desired.

10 Claims, 1 Drawing Sheet

FIG. 1
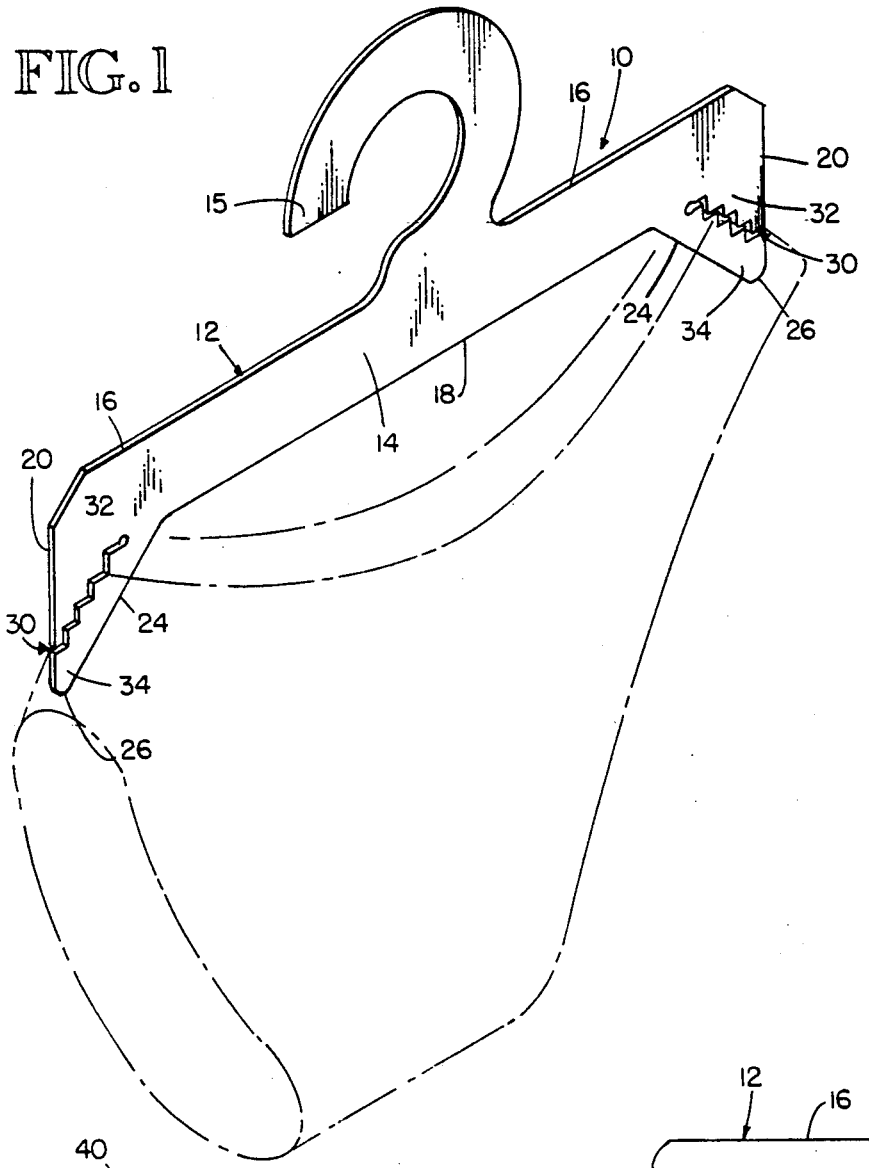
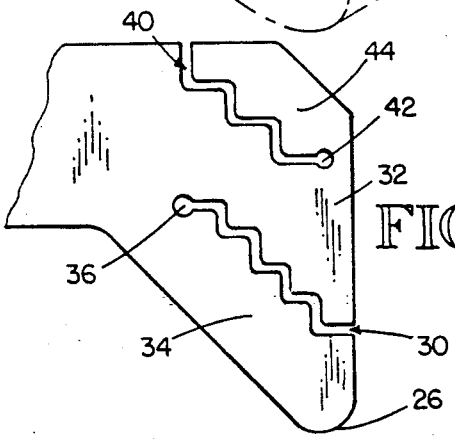
FIG. 3
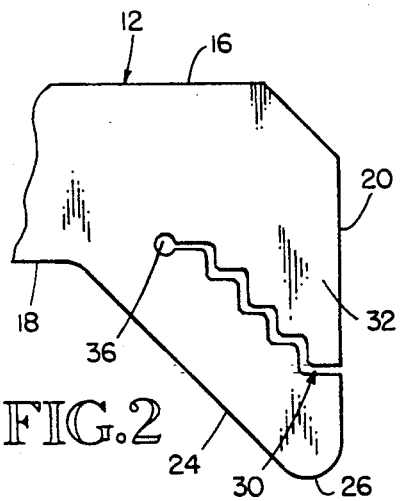
FIG. 2

FLAT GARMENT HANGER WITH RETAINER SLOTS

TECHNICAL FIELD

The present invention relates generally to an inexpensive garment display hanger made of plastic and more particularly to a display hanger which is specially suited to accept womens' under clothing such as underpants, bras, teddies, camisoles, half and full slips and the like.

BACKGROUND ART

Those experienced in retail selling of womens' clothing, most particularly persons in stores or store departments merchandizing lingerie, are well aware of the problems of maintaining a neat and presentable department. The garments are hung on and displayed on racks by the use of inexpensive, flat plastic hangers. Currently used hangers have a common defect in that they do not reliably retain the garment. Stated another way, the garment falls off too easily because the hanger simply does not have a good grip on the fabric of the garment.

The result is that as or while a customer picks up a hanger to inspect the garment, one side falls off so that the article of clothing hangs from one side of the hanger or the garment falls to the floor. The failure of known hangers to hold a garment reasonably securely is a source of frustration to store and department managers because so much employee time is spent rehanging and straightening the merchandize on the hangers to make the area neat and presentable.

Among the known prior art are the following U.S. Pat. Nos. 631,102; 1,607,749; 1,833,388; 1,969,896; 1,962,712; 2,129,871; 2,150,869; 2,222,231; 2,620,103; 2,991,919; 3,317,096; 3,378,180; 4,148,421; 4,623,079; and 4,629,102.

The patents to Bissonette et al., Singer, Carmack and Marble probably are the closest prior art to Applicant's configuration but each completely lacks the functional principles and structural design which Applicant has incorporated in his invention. The hangers in Tendrup, Shafarman and Levitt show the most commonly used types of display hangers but again they fail to solve the primary problem of providing an adequate grip on the garment fabric.

In any event none of prior art patented hangers either alone or in combination anticipates Applicant's unique design to be more fully described and disclosed hereinafter.

DISCLOSURE OF THE INVENTION

The invention is a garment display hanger of flat plastic material. The hanger is a single piece item having an elongated body with a central support hook and at each end has enlarged, depending triangular end portions. A saw tooth slot extends upwardly and inwardly from the outer end edge at a predetermined angle and for a predetermined distance. The saw tooth slot defines triangular, coacting teeth and also divides the end portion into upper and lower end sections. The lower end section flexes under finger pressure so that inserting the garment fabric into the slot is easily achieved. The slot design enables a firm grip by the hanger on the article displayed so that a customer can actually shake the hanger usually without dislodging the garment out of the slots. A second slot may extend downwardly and outwardly from its top edge of the body above the first slot at an angle which roughly parallels the primary slot.

Accordingly, it is among the many features and advantages of the invention to provide a garment display hanger which is simple, inexpensive to manufacture, unique and less susceptible to breakage than other garment display devices. The invention is designed to receive the garment fabric and hold it despite the hanger's being lifted off the rack roughly and reracked just a roughly without the garment thereon pulling loose so that it hangs on one end or falls off completely. The garment once installed on the hanger maintains a clean presentation for customers so that it can be examined repeatedly and not sag or dangle off one end. The invention greatly reduces the employee time required to pick up and rehang articles in order to maintain a neat and presentable display. The hanger functions equally well for a wide variety of fabrics and garment designs. Because it holds a garment better than prior art devices the customer can see the clothing item without taking it off the hanger and holding it up by her fingers to get a good look. The invention enables a smooth appearance of the garment without its sagging or hanging off one end only. The hanger is easy and convenient to handle by employees so that a garment is quickly stretched and hung without difficulty.

BRIEF DESCRIPTION OF THE DRAWINGS

FIG. 1 is a view in perspective of the hanger of this invention showing an undergarment stretched between opposed saw tooth slots;

FIG. 2 is a partial elevational view of an end portion showing additional details of the first or primary saw tooth slot; and FIG. 3 is a partial elevational view of the hanger of FIGS. 1 and 2 with the provision of a secondary saw tooth slot for secondary articles of clothing.

BEST MODE FOR CARRYING OUT THE INVENTION

Referring now to the drawings it will be seen that the hanger of this invention, generally designated by the number 10, has an elongated body 12 made of a single flat piece of plastic such as polystyrene or the like which is about 1/16 inch thick. While the plastic material for the hanger 10 is rigid, it is also has limited flexibility. The body 12 includes arm 14 which has upper edge 16 and bottom edge 18. A centrally located hook 15 extends upwardly in the conventional manner.

At each end of the main body or arm 14 is a depending end section having outer end edge 20, inner edge 24 and lower end 26. As can be seen the edges 20 and 24 and the lower end 26 define a generally triangular shaped end section which extends below the main body lower edge 18. The specific shape of end sections is not critical, so long as the hanger configuration accommodates the holding slots now to be described.

A slot, generally designated by the number 30, is formed in each end section such that an upper end section 32 and a lower end section 34 are defined. Slot 30 is saw tooth shaped. The width of slot 30 is from about 1/32 to about 3/16 inches, with a width of about 1/16th of an inch being the preferred dimension. The slot is formed by alternating horizontal and vertical right angles of approximately ¼ inch length, though such dimension can vary from about ⅛ to about ⅜ inches. The slots angle upwardly and inwardly at approximately a forty-five degree angle though the angle may vary between thirty and sixty degrees with forty-five degrees preferred. The slot begins about ½ inch above the lower end 26. The slot 30 is about 1-½ inches long and terminates at a rounded or circular void 36. The circular void at the slot end is included so as to eliminate the tendency for plastic to crack off square corners. In this regard the coacting triangular teeth defined by the saw tooth slot 30 are also provided with radii to eliminate sharp points that could be damaging to garment fabric.

FIG. 3 shows a second slot 40 which may be formed above the primary slot 30 if it is desired to have the hanger display a greater number of articles of clothing like full slips. It too is saw tooth shaped but is shorter and angles downwardly and outwardly from the top edge 16. Thus it defines a flexible section 44 and ends in circular void 42.

Referring again to FIGS. 1 and 2 it will be appreciated that lower end sections 34 can be flexed with slight finger pressure to insert one side or part of a garment in slot 30. The garment can be then pulled taut across the hanger to the other end and the other side or part of the garment inserted for firm holding.

The hanger may have an overall length from about 6 inches for toddlers' clothes to a maximum of about 14 inches. The preferred length will be about 10 inches from end edge to end edge.

I claim:

1. A hanger for displaying articles of clothing, comprising:

(a) a flat, elongated, one-piece plastic body of predetermined length and thickness and having a top edge and a bottom edge and which is rigid and yet flexible and which includes a hook portion generally centrally of said body and extending upwardly, said body also having a depending end portion at each end of said body such that an end edge is defined at each end, and (b) a slot in each end portion angling generally upwardly and inwardly from each said end edge a predetermined distance, said slot being generally saw tooth in form such that a series of triangular coacting teeth are defined and said slot also defining a lower end portion which is sufficiently flexible under finger pressure to be flexed for insertion of garment fabric therein.

2. The garment display hanger according to claim 1 wherein said slot angles upwardly and inwardly at an angle of between about thirty to sixty degrees.

3. The garment display hanger according to claim 1 wherein said slot angles upwardly and inwardly at an angle of about forty-five degrees.

4. The garment display hanger according to claim 1 wherein said slot is about 1/16 inch wide and about 1-½ inches long.

5. The garment display hanger according to claim 1 wherein said generally triangular teeth are defined by alternating horizontal and vertical jogs at about ninety degree angles to each other.

6. The garment display hanger according to claim 1 wherein said slot terminates in a generally circular void.

7. The garment display hanger according to claim 1 wherein said hanger includes a secondary garment holding slot above each said slot and extends downwardly and outwardly from the upper edge of said body and is also saw tooth in shape.

8. The garment display hanger according to claim 2 wherein said slot is about 1/16 inch wide and about 1-½ inches long.

9. The garment display hanger according to claim 8 wherein said generally triangular teeth are defined by by alternating horizontal and vertical jogs at about ninety degree angles to each.

10. The garment display hanger according to claim 9 wherein said hanger includes a secondary garment holding slot above each said slot and extends downwardly and outwardly from the upper edge of said body and is also saw tooth in shape.

* * * * *